US007315135B2

(12) United States Patent
Kang et al.

(10) Patent No.: US 7,315,135 B2
(45) Date of Patent: Jan. 1, 2008

(54) LOAD DRIVING DEVICE AND LOAD DRIVING METHOD

(75) Inventors: Jeong-il Kang, Yongin-si (KR); Sang-hoon Lee, Ulsan (KR); Kyoung-geun Lee, Suwon-si (KR); Yung-jun Park, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/346,341

(22) Filed: Feb. 3, 2006

(65) Prior Publication Data

US 2007/0001619 A1 Jan. 4, 2007

(30) Foreign Application Priority Data

Jul. 1, 2005 (KR) ..... 10-2005-0059377

(51) Int. Cl.
*H05B 41/24* (2006.01)

(52) U.S. Cl. ..... 315/247; 315/246; 315/229; 315/308; 315/360

(58) Field of Classification Search ..... 315/247, 315/224, 291, 307, 223; 323/284, 282, 229
See application file for complete search history.

(56) References Cited

U.S. PATENT DOCUMENTS 5,424,618 A * 6/1995 Bertenshaw et al. ..... 315/324
6,346,778 B1 * 2/2002 Mason et al. ..... 315/291
6,864,643 B2 * 3/2005 Min et al. ..... 315/246
6,930,898 B2 * 8/2005 Jeon et al. ..... 363/98
7,102,340 B1 * 9/2006 Ferguson ..... 323/284
2004/0179003 A1 * 9/2004 Jang ..... 345/204
2004/0196225 A1 * 10/2004 Shimada ..... 345/82
2005/0110732 A1 * 5/2005 Kim ..... 345/87

(Continued)

FOREIGN PATENT DOCUMENTS

JP 11-305198 11/1999

(Continued)

OTHER PUBLICATIONS

"Application Note 40 LEDs vs. CCFL Final"; Micrel Inc., Aug. 2002, no date available.

(Continued)

*Primary Examiner*—Douglas W. Owens
*Assistant Examiner*—Chuc Tran
(74) *Attorney, Agent, or Firm*—Roylance, Abrams, Berdo & Goodman, L.L.P.

(57) ABSTRACT

Provided is a load driving device controlling a drive of a load including a driver for periodically turning on/off a current according to a switching clock signal and supplying a average driving current to the load. Further provided is a dimming controller for controlling the driver to turn on/off the drive of the load based on a dimming step. Also provided is a controller for controlling at least one of the driver and the dimming controller so as to make a step interval of the dimming step and a switching clock period of the switching clock signal the same. A load driving device is provided that is capable of stably controlling the dimming of a drive of a load, by improving a linear response characteristic of a driving current according to a dimming control.

14 Claims, 5 Drawing Sheets

U.S. PATENT DOCUMENTS

| | | | | |
|---|---|---|---|---|
| 2005/0156536 | A1* | 7/2005 | Ball | 315/291 |
| 2005/0225259 | A1* | 10/2005 | Green | 315/224 |
| 2006/0238174 | A1* | 10/2006 | Russell et al. | 323/229 |

FOREIGN PATENT DOCUMENTS

| | | |
|---|---|---|
| JP | 2000-214825 | 8/2000 |
| JP | 2001-272938 | 10/2001 |
| KR | 2004-075038 | 8/2004 |

OTHER PUBLICATIONS

"Application Note 40 LEDs vs. CCFL Final"; Micret Inc., Aug. 2002.

* cited by examiner

LOAD DRIVING DEVICE AND LOAD DRIVING METHOD

CROSS-REFERENCE TO RELATED APPLICATIONS

This application claims the benefit under 35 U.S.C. § 119(a) of Korean Patent Application No. 2005-0059377, filed Jul. 1, 2005, in the Korean Intellectual Property Office, the entire disclosure of which is hereby incorporated by reference.

BACKGROUND OF INVENTION

1. Field of Invention

The present invention relates to a load driving device controlling a load. More particularly, the present invention relates to a load driving device capable of stably controlling the dimming of the drive of a load by improving a linear response characteristic of a driving current.

2. Description of the Related Art

Conventionally, a load driving device drives a load and is capable of stepwise control of a drive strength. Exemplary loads include a cooling fan, a heater and a backlight. The conventional load driving device employs a Pulse Width Modulation (PWM) dimming method for stepwise control of the drive strength for the load.

A conventional load driving device includes a switching current source supplying a predetermined average driving current to the load by periodically switching a current according to a predetermined switching period. A PWM dimming part outputs a PWM dimming signal for turning on/off the switching current source based on a predetermined dimming step for stepwise control of the drive strength for the load. The dimming step is synchronized by a synchronizing signal of a main circuit part (not shown) of the load driving device, and the switching period has a different period than the synchronizing signal of the main circuit part (not shown).

The change of a load driving current according to the change of a dimming duty ratio in the conventional load driving device will be described with reference to FIG. 1. Herein, the dimming duty ratio refers to a sum of step intervals, Ton of the dimming steps outputting the ON PWM dimming signal within a dimming period Td. There may be a plurality of dimming steps within the dimming period Td. That is, the dimming duty ratio is Ton/Td.

The switching current source of the conventional load driving device, referring to (1-1) of FIG. 1, turns on the switching part (not shown) at $t_1$, $t_2$, $t_3$, $t_4$ according to the switching period T'. The switching current source turns off the switching part if the current supplied to the load reaches a predetermined command value ir. Therefore, a driving current i maintains an average driving current using pulses such as in (1-1) of FIG. 1. The PWM dimming part outputs the PWM dimming signal which turns on/off the switching current source, on the basis of the plurality of dimming steps $d_1$, $d_2$, $d_3$, $d_4$, $d_5$ according to the step interval d', as shown in (1-1) of FIG. 1. Accordingly, if the PWM dimming signal is interrupted, the switching current source stops to supply the current to the load. Herein, the step interval d' is different from the switching period T'.

Therefore, the change of the load driving current according to the change of the dimming duty ratio will be described with reference to (1-2) through (1-5) of FIG. 1. As shown therein, the dimming duty ratio becomes larger in order of (1-2)<(1-3)<(1-4)<(1-5).

Referring to (1-2) of FIG. 1, if the PWM dimming part interrupts the PWM dimming signal at the dimming step $d_1$ then the dimming duty ratio is $d_1$/Td. The switching current source turns off the switching part at $d_1$, thereby interrupting the current supplied to the load during the rest of dimming period Td. Therefore, the average driving current $i_{1'}$ is supplied to the load during the dimming period Td. Referring to (1-3) of FIG. 1, if the PWM dimming part interrupts the PWM dimming signal at the dimming step $d_2$ then the dimming duty ratio is $d_2$/Td. The switching current source turns off the switching part at $d_2$, thereby interrupting the current supplied to the load during the rest of dimming period Td. Therefore, the average driving current $i_{2'}$ is supplied to the load during the dimming period Td. Referring to (1-4) of FIG. 1, if the PWM dimming part interrupts the PWM dimming signal at the dimming step $d_3$ then the dimming duty ratio is $d_3$/Td. The switching current source turns off the switching part at $d_3$, thereby interrupting the current supplied to the load during the rest of dimming period Td. Therefore, the average driving current $i_{3'}$ is supplied to the load during the dimming period Td. Referring to (1-5) of FIG. 1, if the PWM dimming part interrupts the PWM dimming signal at the dimming step $d_4$ then the dimming duty ratio is $d_4$/Td. The switching current source turns off the switching part at $d_4$, thereby interrupting the current supplied to the load during the rest of dimming period Td. Therefore, the average driving current $i_{4'}$ is supplied to the load during the dimming period Td.

Referring to FIG. 1, in the conventional load driving device, the average driving current which is supplied to the load may be not changed linearly. That is, the average driving currents $i_{1'}$ and $i_{2'}$ are both the same even though the (1-2) dimming duty ratio $d_1$/Td is different from the (1-3) dimming duty ratio $d_2$/Td. Therefore, in the case of (1-2) and (1-3), the effect on the load will be same even though each dimming duty ratio is different. Further, the average driving currents $i_{3'}$ and $i_{4'}$ are both almost the same even though the (1-4) dimming duty ratio $d_3$/Td is different from the (1-5) dimming duty ratio $d_4$/Td. Therefore, in case of (1-4) and (1-5), the effect on the load will be almost same even though each dimming duty ratio is different. The phenomena described above, appears more when the variation of the change of the dimming duty ratio is smaller than a switching off interval within the switching period.

With the conventional load driving device, the average driving current supplied to the load is not changed linearly corresponding to the change of the dimming duty ratio for stepwise control of the drive strength of the load. As such, the conventional load driving device is limited in being able to stably control a driving response of the load according to the dimming duty ratio.

Accordingly, there is a need for an improved load driving device controlling a load that can stably control a driving response of a load according to a dimming duty ratio.

SUMMARY OF THE INVENTION

An aspect of the present invention is to address at least the above problems and/or disadvantages and to provide at least the advantages described below. Accordingly, an aspect of exemplary embodiments of the present invention provides a load driving device capable of stably controlling the dimming of a drive of a load, by improving a linear response characteristic of a driving current according to a dimming control.

The foregoing and other objects are substantially realized by providing a load driving device controlling a drive of a load comprising a driver for periodically turning on/off a current according to a switching clock signal and supplying a average driving current to the load. Further provided is a dimming controller for controlling the driver to turn on/off the drive of the load based on a dimming step. Also provided is a controller for controlling at least one of the driver and the dimming controller so as to make a step interval of the dimming step and a switching clock period of the switching clock signal the same.

According to an aspect of an exemplary embodiment of the present invention, the load comprises a Light Emitting Diode (LED) backlight having a plurality of LEDs.

According to an aspect of an exemplary embodiment of the present invention, the driver comprises a switching current source having a power source part for supplying the current to the LED backlight, a switching part for turning on/off a flow of the current supplied from the power source part to the LED backlight, and a switching controller for controlling periodically the switching part according to the switching clock signal so that the current flowing in the LED backlight is maintained at the average driving current according to a peak value.

According to an aspect of an exemplary embodiment of the present invention, the controller supplies to the switching controller a clock signal having the clock period the same as the step interval of the dimming step, the clock signal is functioning as the switching clock signal.

According to an aspect of an exemplary embodiment of the present invention, the controller supplies to the switching controller a clock signal synchronized with the dimming step, the clock signal is functioning as the switching clock signal.

According to an aspect of an exemplary embodiment of the present invention, the dimming controller includes a PWM dimming circuit part for outputting a PWM dimming control signal for controlling the drive to turn on/off the drive of the load based on the dimming step.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
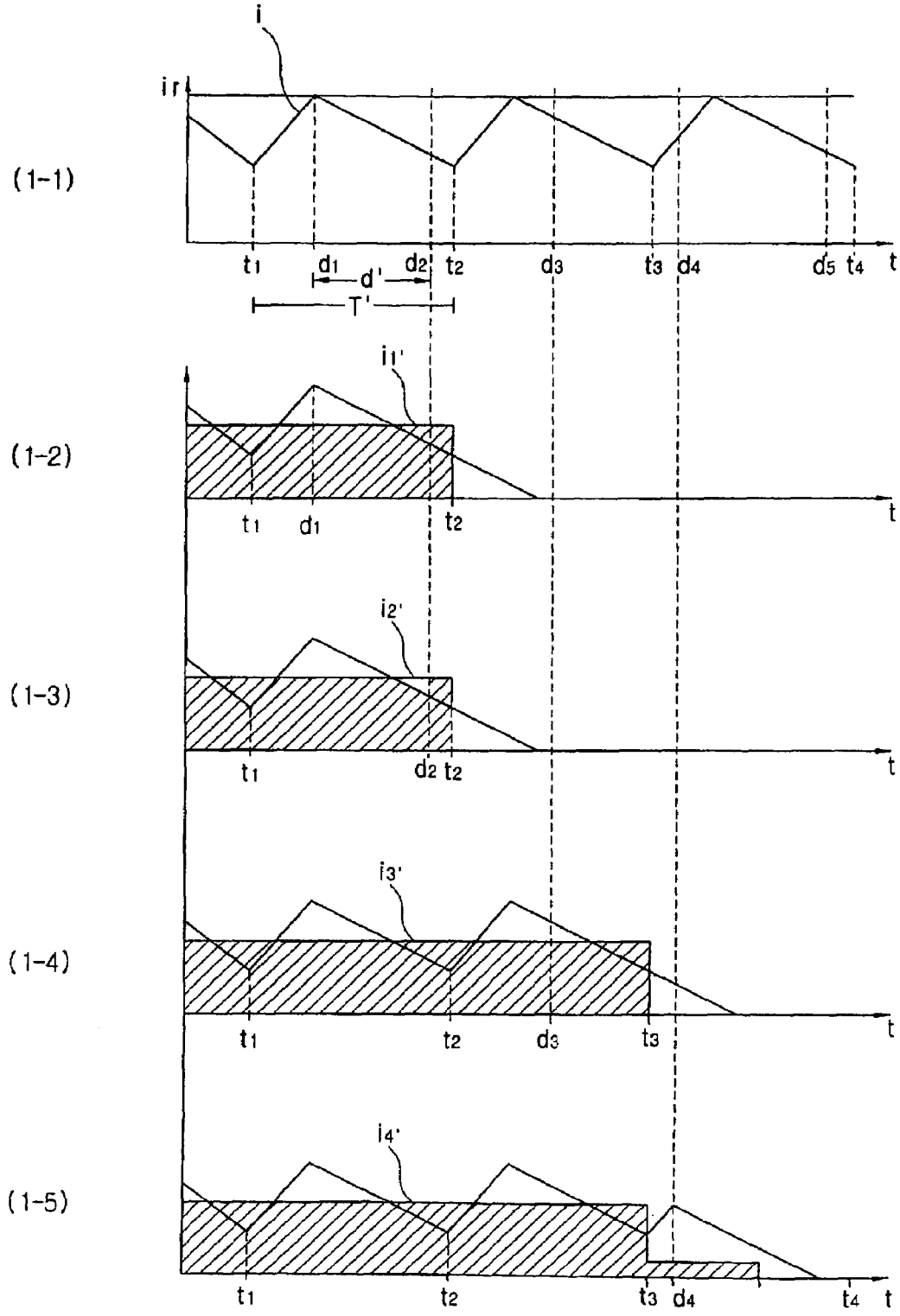
FIG. 1 (PRIOR ART)
FIG. 1 illustrates a change of a load driving current according to a change of a dimming duty ratio in a conventional load driving device.
Figure 2:
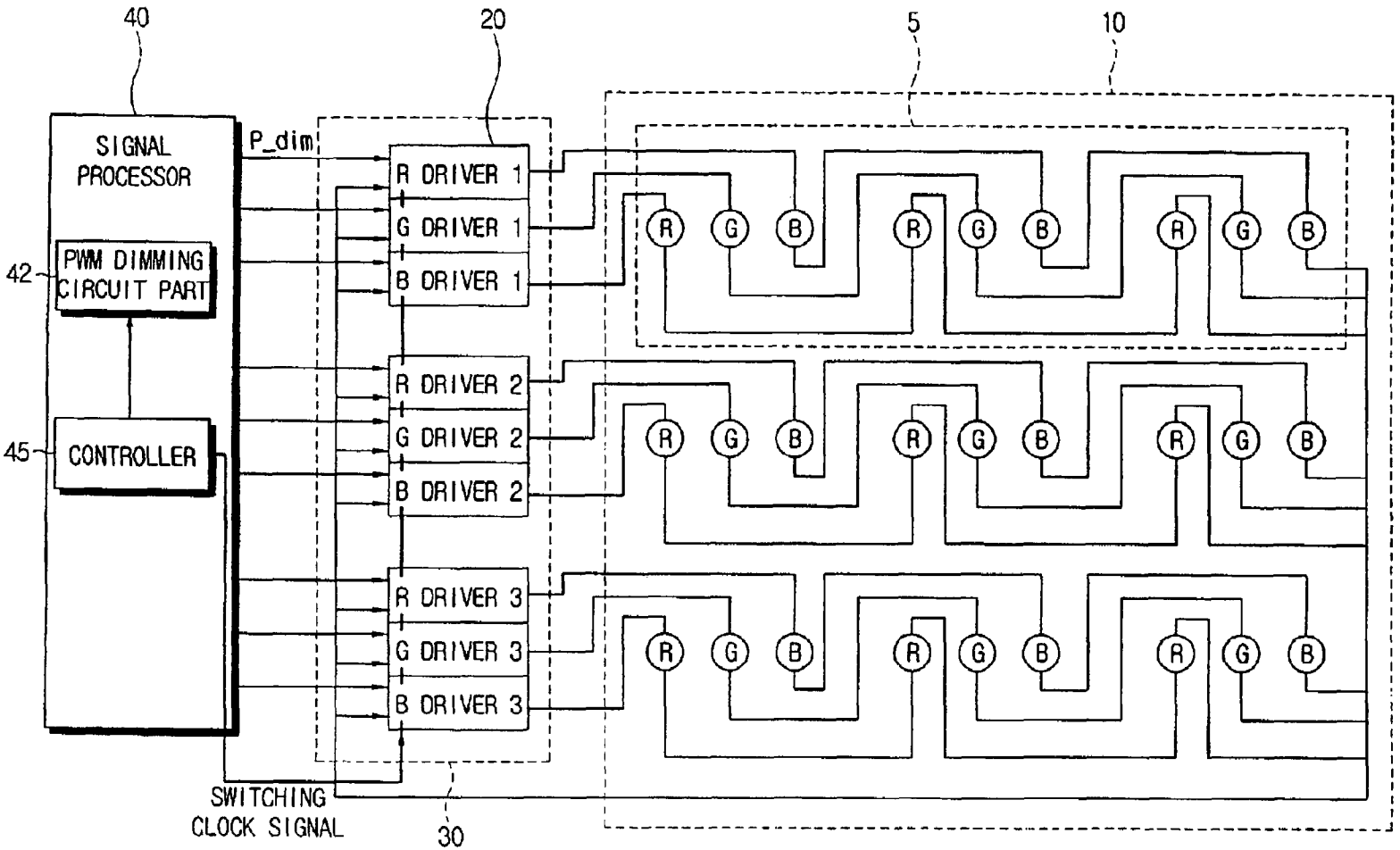
FIG. 2 is a control block diagram of a load driving device in accordance with an exemplary embodiment of the present invention.

FIG. 2 is a control block diagram of a load driving device in accordance with an exemplary embodiment of the present invention. As shown therein, the load driving device according to an exemplary embodiment of the present invention includes an LED backlight 10 serving as a load. Further included, is a driver 30 supplying a predetermined average driving current to the LED backlight 10 by periodically switching a current according to a predetermined switching clock signal. Additionally included, is a signal processor 40 controlling the driver 30 so as to turn on/off a drive of the LED backlight 10 based on a predetermined dimming step, and to make a step interval of the dimming step and a switching clock period of the switching clock signal the same.

The LED backlight 10 supplies light to a display part (not shown) for displaying an image, by serving as the load having a driven strength, such as a brightness, controlled according to a size of the driving current supplied. The LED backlight 10 may comprise a plurality of LED lines 5 provided with a plurality of LEDs which display a red color R, a green color G, and a blue color B.

The driver 30 supplies the driving current to the LED backlight 10. The driver 30 may be provided with at least one or more drivers. A first driver 20 is provided with a R driver 1, G driver 1, a B driver 1 which controls respectively a plurality of LED elements 5 displaying the red color R of the LED, a plurality of LED elements displaying the green color G, and a plurality of LED elements displaying the blue color B.

The driver 30 includes a switching current source 27 which periodically turns on/off a flow of the current supplied to the LED backlight 10. The current flow is periodically turned on/off according to the switching clock signal so that the current flowing into the LED backlight is maintained as the average driving current according to a predetermined peak value.

Figure 3:
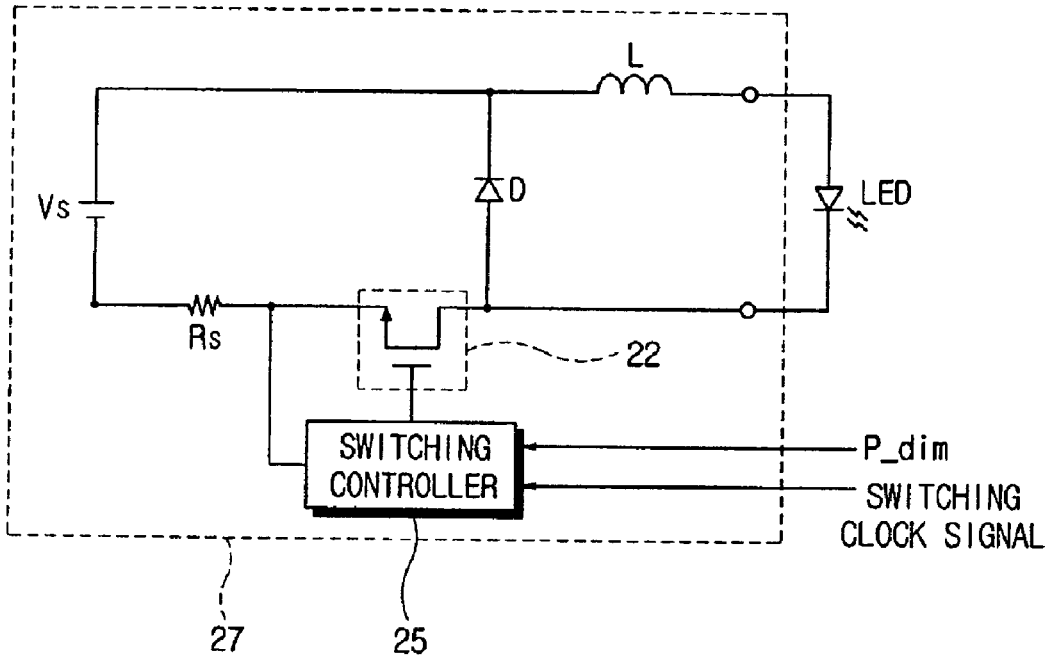
FIG. 3 is a detailed circuit diagram of a switching current source in the load driving device of FIG. 2.

FIG. 3 is a detailed circuit diagram of the switching current source 27 in the load driving device of FIG. 2. As shown therein, the switching current source 27 includes a power source Vs which generates the power to be supplied to the LED backlight 10. Further included is a sensing resistance Rs which senses the amount of the current flowing through the LED backlight 10. Additionally included is a current maintaining switching part 22 which turns on/off the flow of the current supplied from the power source Vs to the LED backlight 10. Also included is a switching controller 25 which turns off the current maintaining switching part 22 and periodically turns on the current maintaining switching part 22 according to the switching clock signal if it is determined that the amount of the current sensed through the sensing resistance Rs reaches the peak value. Therefore, the switching current source 27 periodically turns on the current maintaining switching part 22 according to the switching clock signal, and turns off the current maintaining switching part 22 if the current supplied to the LED backlight 10 reaches the peak value. Accordingly, the driving current supplied to the LED backlight 10 is maintained at an average driving current by cycling the supplied current.

The switching controller 25 supplies the average driving current to the LED backlight 10 by periodically turning on/off the current maintaining switching part 22 according to the switching clock signal when a PWM dimming control signal P_dim output from the signal processor 40 is in the on state. Further, the switching current source 25 does not supply current to the LED backlight 10 if the current maintaining switching part 22 is turned off due to the PWM dimming control signal P_dim output from the signal processor 40 being in an off state.

Signal processor 40 includes a PWM dimming circuit part 42 outputting the PWM dimming control signal P_dim to the switching controller 25 for controlling the driver 30 so as to turn on/off the drive of the LED backlight 10 based on a predetermined dimming step. Further, signal processor 40 includes controller 45 controlling at least one of the PWM dimming circuit part 42 and the driver 30 to make the step interval of the dimming step and a switching clock period of the switching clock signal the same.

The PWM dimming circuit part 42 outputs the PWM dimming control signal P_dim which turns on/off the drive of the driver 30 every dimming period Td, on the basis of the plurality of dimming steps in the dimming period Td. Therefore, if the driver 30 is turned off in an initial dimming step of the dimming period Td, the brightness of the LED backlight 10 decreases. That is, the brightness of the LED backlight 10 is different according to a dimming duty ratio. The dimming ratio refers to a sum Ton of the step interval of the dimming steps outputting the ON PWM dimming signal within the dimming period Td. That is, the dimming duty ratio is Ton/Td in consideration of a plurality of dimming steps within the dimming period Td. The LED backlight 10 gets brighter as the dimming duty ratio approaches 1. Generally, the dimming steps of the PWM dimming circuit part 42 are synchronized by a synchronizing signal of a main circuit part (not shown) of the load driving device.

The controller 45 may supply to switching controller 25*a* clock signal, as the switching clock signal, which has its clock period the same as each step interval of the dimming steps. Finally, the controller 45 generates the clock signal, as the switching clock signal, having its clock period the same as a synchronizing period of the synchronizing signal of the main circuit part (not shown) of the load driving device, thereby supplying the clock signal to switching controller 25.

The change of the load driving current according to the change of the dimming duty ratio in the load driving device of an exemplary embodiment of the present invention will be described with reference to FIG. 4 as follow.

Figure 4:
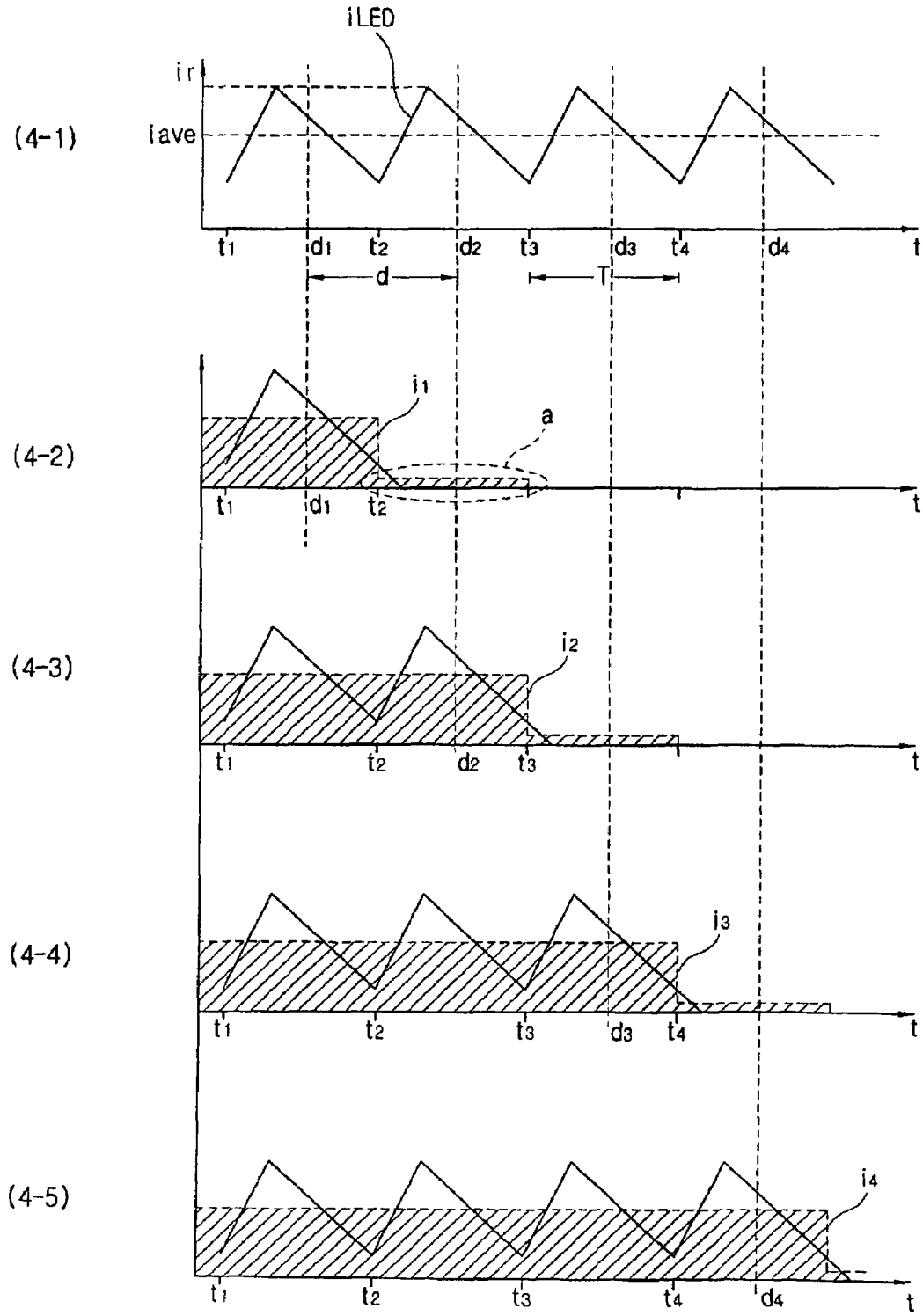
FIG. 4 illustrates a change of a load driving current according to a change of a dimming duty ratio in accordance with an exemplary embodiment of the present invention.

The switching current source 27 of the driver 30, referring to (4-1) of FIG. 4, turns on the current maintaining switching part 22 at $t_1$, $t_2$, $t_3$, $t_4$ according to the switching clock period T with respect to the switching clock signal input from the controller 45, and turns off the current maintaining switching part 22 if the current supplied to the LED backlight 10 reaches a predetermined peak value ir. Therefore, the driving current iLED supplied to the LED backlight 10 maintains an average driving current iave by pulsing such shown in (4-1) of FIG. 4.

At this time, the PWM dimming circuit part 42 outputs the PWM dimming control signal P_dim which turns on/off the switching current source 27, to the switching controller 25, on the basis of the plurality of dimming steps $d_1$, $d_2$, $d_3$, $d_4$ according to the step interval d. Accordingly, if the PWM dimming control signal P_dim is interrupted, the switching controller 25 turns off the current maintaining switching part 22 and the switching current source 27 stops to supply the current to the LED backlight. Herein, controller 45 outputs the clock signal to the switching controller 25 having a clock period that is the same as the step interval d of the dimming step, so that the step interval d is the same size as the switching clock period T. Hereon, the clock signal is functions as the switching clock signal Therefore, the change of the load driving current according to the change of the dimming duty ratio will be described with reference to (4-2) through (4-5) of FIG. 4. As shown therein, the dimming duty ratio becomes larger in order of (4-2)<(4-3)<(4-4)<(4-5).

Referring to (4-2) of FIG. 4, if the PWM dimming circuit part 42 interrupts the PWM dimming control signal at the dimming step $d_1$ then the dimming duty ratio is $d_1$/Td. The switching current source 27 turns off the current maintaining switching part 22 at $d_1$, thereby interrupting the current supplied to the LED backlight 10 during the rest of dimming period Td. Therefore, the average driving current $i_1$ is supplied to the LED backlight 10 during the dimming period Td. Herein, a residue current 'a' may generate temporally when the current maintaining switching part 22 at $d_1$ are turned off, thereby interrupting the current supplied to the LED backlight 10. The residue current 'a' does not have a strong influence on the brightness control of LED backlight 10.

Referring to (4-3) of the FIG. 4, if the PWM dimming circuit part 42 interrupts the PWM dimming control signal at the dimming step $d_2$ then the dimming duty ratio is $d_2$/Td. The switching current source 27 turns off the current maintaining switching part 22 at $d_2$, thereby interrupting the current supplied to the LED backlight 10 during the rest of dimming period Td. Therefore, the average driving current $i_2$ is supplied to the LED backlight 10 during the dimming period Td.

Referring to (4-4) of the FIG. 4, if the PWM dimming circuit part 42 interrupts the PWM dimming control signal at dimming step $d_3$ then the dimming duty ratio is $d_3$/Td. The switching current source 27 turns off the current maintaining switching part 22 at $d_3$, thereby interrupting the current supplied to the LED backlight 10 during the rest of dimming period Td. Therefore, the average driving current $i_3$ is supplied to the LED backlight 10 during the dimming period Td.

Referring to (4-5) of the FIG. 4, if the PWM dimming circuit part 42 interrupts the PWM dimming control signal at the dimming step $d_4$ then the dimming duty ratio is $d_4$/Td. The switching current source 27 turns off the current maintaining switching part 22 at $d_4$, thereby interrupting the current supplied to the LED backlight 10 during the rest of dimming period Td. Therefore, the average driving current $i_4$ is supplied to the LED backlight 10 during the dimming period Td.

Referring to FIG. 4, in the load driving device of the exemplary embodiment of the present invention, the average driving current which is supplied to the LED backlight 10 is linearly changed. The average driving current corresponds to the change of the dimming duty ratio so as to stepwise control a driving strength of the LED backlight 10, such as brightness of the backlight 10. That is, the average driving current $i_1 \rightarrow i_2 \rightarrow i_3 \rightarrow i_4$ becomes larger as the dimming ratio approaches "1" in the order of (4-2)→(4-3)→(4-4)→(4-5). In this manner, because the step interval d of the dimming step is the same as the switching clock period T, the brightness of the LED backlight 10 is changed linearly by corresponding to the change of the dimming duty ratio.

Alternatively, the controller can control the PWM dimming circuit part 42 so as to have the step interval d be the same as the switching period T of the switching controller 25.

Figure 5:
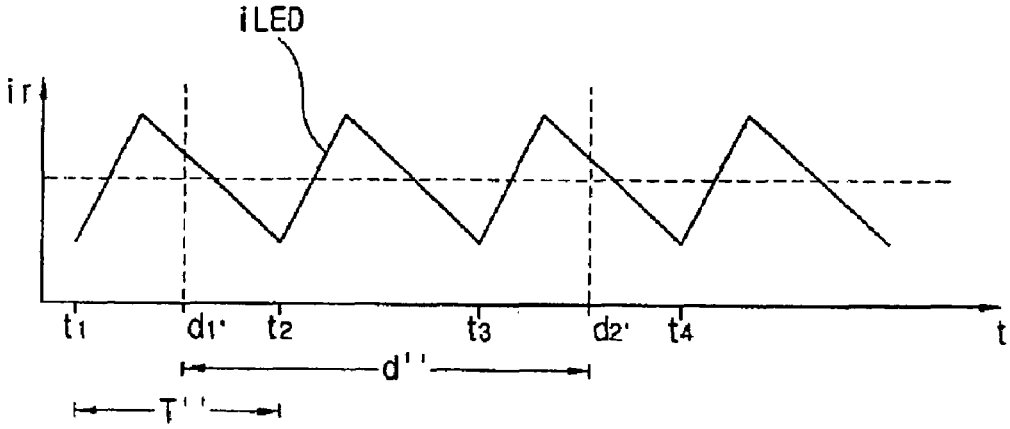
FIG. 5 illustrates a dimming step and a clock signal in a load driving device having a switching clock period in accordance with another exemplary embodiment of the present invention.

Further, referring to FIG. 5, the controller 45 may generate a switching clock signal for switching controller 25 having a switching clock period T" corresponding to 1/n of the step interval d" of the dimming step. Therefore, dimming steps $d_{1'}$ and $d_{2'}$ exist at the same current level of the driving current iLED supplied to the LED backlight 10. This stably maintains the liner brightness change of the LED backlight 10 corresponding to the change of the effective dimming duty ratio of an exemplary embodiment of the present invention.

The load driving device of exemplary embodiments of the present invention improves a linear response characteristic of the average driving current supplied to the load 10 by corresponding to the change of the dimming duty ratio for stepwise controlling the driving strength of the load 10, thereby stably controlling the driving response of the load 10 according to the dimming duty ratio.

While the invention has been shown and described with reference to certain embodiments thereof, it will be understood by those skilled in the art that various changes in form and details may be made therein without departing from the spirit and scope of the invention as defined by the appended claims.

What is claimed is:

1. A load driving device controlling a drive of a load, comprising:

a driver for periodically turning on/off a current according to a switching clock signal and supplying an average driving current to the load;

a dimming controller for controlling the driver to turn on/off the drive of the load based on a dimming step; and a controller for controlling at least one of the driver and the dimming controller so as to make a step interval of the dimming step and a switching clock period of the switching clock signal the same.

2. The load driving device according to claim 1, wherein the load comprises a Light Emitting Diode (LED) backlight having a plurality of LEDs.

3. The load driving device according to claim 2, wherein the driver comprises a switching current source having a power source part for supplying the current to the LED backlight, a switching part for turning on/off a flow of the current supplied from the power source part to the LED backlight, and a switching controller for controlling periodically the switching part according to the switching clock signal so that the current flowing in the LED backlight is maintained at the average driving current according to a predetermined peak value.

4. The load driving device according to claim 3, wherein the controller supplies to the switching controller a clock signal having the clock period the same as the step interval of the dimming step, the clock signal functioning as the switching clock signal.

5. The load driving device according to claim 3, wherein the controller supplies to the switching controller a clock signal synchronized with the dimming step, the clock signal functioning as the switching clock signal.

6. The load driving device according to claim 5, wherein the dimming controller includes a PWM dimming circuit part for outputting a PWM dimming control signal for controlling the driver to turn on/off the drive of the load based on the dimming step.

7. The load driving device according to claim 4, wherein the dimming controller includes a PWM dimming circuit part for outputting a PWM dimming control signal for controlling the driver to turn on/off the drive of the load based on the dimming step.

8. A load driving method for controlling a drive of a load, comprising the steps of:

driving by a driver periodically turning on/off a current according to a switching clock signal and supplying an average driving current to the load;

controlling dimming by a dimming controller controlling the driver to turn on/off the drive of the load based on a dimming step; and controlling by a controller controlling at least one of the driver and the dimming controller so as to make a step interval of the dimming step and a switching clock period of the switching clock signal the same.

9. The load driving device according to claim 8, wherein the load comprises a Light Emitting Diode (LED) backlight having a plurality of LEDs.

10. The load driving method according to claim 9, wherein the driving comprises current switching by a switching current source having a power source part supplying the current to the LED backlight, switching by a switching part turning on/off a flow of the current supplied from the power source part to the LED backlight, and control switching by a switching controller controlling periodically the switching part according to the switching clock signal so that the current flowing in the LED backlight is maintained at the average driving current according to a predetermined peak value.

11. The load driving method according to claim 10, wherein the controlling at least one of the driver and the dimming controller comprises the controller supplying to the switching controller a clock signal having the clock period the same as the step interval of the dimming step, the clock signal functioning as the switching clock signal.

12. The load driving method according to claim 10, wherein the controlling at least one of the driver and the dimming controller comprises the controller supplying to the switching controller a clock signal synchronized with the dimming step, the clock signal functioning as the switching clock signal.

13. The load driving method according to claim 12, wherein the controlling dimming comprises the dimming controller including a PWM dimming circuit part for outputting a PWM dimming control signal for controlling the driver to turn on/off the drive of the load based on the dimming step.

14. The load driving method according to claim 11, wherein the controlling dimming comprises the dimming controller including a PWM dimming circuit part for outputting a PWM dimming control signal for controlling the driver to turn on/off the drive of the load based on the dimming step.

* * * * *